US009079240B2

(12) United States Patent
Schiffler et al.

(10) Patent No.: US 9,079,240 B2
(45) Date of Patent: Jul. 14, 2015

(54) METHOD FOR PLACING RIVET ELEMENTS BY MEANS OF A PORTABLE RIVETING DEVICE DRIVEN BY AN ELECTRIC MOTOR AND RIVETING DEVICE

(75) Inventors: Rupert Schiffler, Loiching (DE); Hans-Martin Hanke, Efringen-Kirchen (DE)

(73) Assignee: HS-TECHNIK GMBH (DE)

( * ) Notice: Subject to any disclaimer, the term of this patent is extended or adjusted under 35 U.S.C. 154(b) by 1435 days.

(21) Appl. No.: 12/747,218

(22) PCT Filed: Dec. 10, 2008

(86) PCT No.: PCT/EP2008/010491

§ 371 (c)(1),
(2), (4) Date: Jun. 10, 2010

(87) PCT Pub. No.: WO2009/074312

PCT Pub. Date: Jun. 18, 2009

(65) Prior Publication Data

US 2010/0257720 A1 Oct. 14, 2010

(30) Foreign Application Priority Data

Dec. 10, 2007 (DE) ..... 10 2007 059 422

(51) Int. Cl.
*B21J 15/02* (2006.01)
*B21J 15/28* (2006.01)
(Continued)

(52) U.S. Cl.
CPC ..... *B21J 15/285* (2013.01); *B21J 15/043* (2013.01); *B21J 15/105* (2013.01); *B21J 15/26* (2013.01); *Y10T 29/49956* (2015.01); *Y10T 29/5377* (2015.01)

(58) Field of Classification Search
CPC ..... B21J 15/285
USPC ..... 29/243.5, 243.53, 243.58, 407.01, 29/407.04, 407.05, 407.09, 407.1, 524.1, 29/525.06, 709, 716, 798
See application file for complete search history.

(56) References Cited

U.S. PATENT DOCUMENTS 4,762,261 A 8/1988 Hawly
5,655,289 A * 8/1997 Wille et al. ..... 29/703
(Continued)

FOREIGN PATENT DOCUMENTS

DE 4339117 A1 5/1995
DE 4429225 A1 2/1996
(Continued)

OTHER PUBLICATIONS

Japanese Office Action for corresponding application 2010-536384, dated Dec. 21, 2012; Mail date Jan. 8, 2013.
(Continued)

*Primary Examiner* — David Bryant
*Assistant Examiner* — Steven A Maynard
(74) *Attorney, Agent, or Firm* — Cantor Colburn LLP

(57) ABSTRACT

The present invention relates to a method for placing rivet elements by means of a portable riveting device driven by an electric motor, comprising a placing device, wherein the force of the placing device utilized to place a rivet element is monitored based on the current consumed by the electric motor, wherein the path traveled by the rivet clement during the placement operation and/or traveled by the placing device during the placement operation of the rivet element is repeatedly measured by at least one sensor unit, and wherein the force of the placing device exerted on the respective measuring point is determined at the respective measuring point and is compared to a reference force value range for the respective measuring point, wherein the placement operation of the rivet element is not qualitatively accepted, if at a measuring point the force of the placing device exerted at said measuring point is outside the reference force value range for said measuring point.

19 Claims, 2 Drawing Sheets

(51) Int. Cl.

| | |
|---|---|
| ***B21J 15/04*** | (2006.01) |
| ***B21J 15/10*** | (2006.01) |
| ***B21J 15/26*** | (2006.01) |

(56) References Cited

U.S. PATENT DOCUMENTS

| | | | | |
|---|---|---|---|---|
| 6,145,360 | A * | 11/2000 | Honsel et al. | 72/19.8 |
| 6,851,167 | B2 * | 2/2005 | Harlow et al. | 29/407.01 |
| 7,024,270 | B2 * | 4/2006 | Mauer et al. | 700/175 |
| 7,123,982 | B2 | 10/2006 | Mauer et al. | |
| 7,313,852 | B2 * | 1/2008 | Peckham et al. | 29/243.53 |
| 7,471,892 | B2 * | 12/2008 | Spaulding et al. | 396/429 |
| 7,752,739 | B2 * | 7/2010 | Mauer et al. | 29/716 |
| 7,788,780 | B2 * | 9/2010 | King | 29/243.523 |
| 7,802,352 | B2 * | 9/2010 | Chitty et al. | 29/524.1 |
| 8,079,242 | B2 * | 12/2011 | Pacaud et al. | 72/21.4 |
| 8,082,647 | B2 * | 12/2011 | Patton | 29/407.08 |
| 2003/0034355 | A1 | 2/2003 | Bloch et al. | |
| 2007/0067986 | A1 | 3/2007 | Chitty | |

FOREIGN PATENT DOCUMENTS

| | | | |
|---|---|---|---|
| DE | 102006042699 | A1 | 3/2007 |
| DE | 102005054048 | A1 | 5/2007 |
| EP | 0454890 | A1 | 11/1991 |
| EP | 0653259 | A1 | 5/1995 |
| JP | 164092 | A | 6/1995 |
| JP | 2007203307 | A | 8/2007 |
| WO | 2005097375 | A1 | 10/2005 |

OTHER PUBLICATIONS

International Search Report PCT/EP2008/010491; Dated Mar. 31, 2009.

* cited by examiner

METHOD FOR PLACING RIVET ELEMENTS BY MEANS OF A PORTABLE RIVETING DEVICE DRIVEN BY AN ELECTRIC MOTOR AND RIVETING DEVICE

TECHNICAL FIELD

The present invention concerns a method for setting of rivet elements with a portable riveting tool driven by an electric motor, having a setting device, in which the force of the setting device, with which a rivet element is set, is monitored by means of the current consumed by the electric motor. The invention also concerns a portable riveting tool for setting of rivet elements, which is driven by an electric motor.

BACKGROUND

Setting of rivet elements is generally known. A method for setting of rivet elements with a riveting tool driven by an electric motor is known from DE 10 2005 054 048 A1. The quality of the setting process is monitored by means of the electric current consumed by the electric motor of the riveting tool. The quality of the setting process is then viewed as acceptable, if the maximum current consumed by the electric motor during the setting process lies within a stipulated value range. A shortcoming in this method is that the quality of the setting process of the riveting tool is only evaluated by means of the maximum consumed current. This permits only a retrospective view of the setting process. The rivet process is conducted to the end in this method. Consequently, it cannot be evaluated at which location of the setting process the setting process was conducted incorrectly. It can therefore happen that the maximum consumed current lies within the stipulated value range. However, it cannot be recognized that an error occurred in the setting process before or after reaching the maximum consumed current. However, if the rivet was pulled too quickly or too slowly at a location during the setting process, this cannot be established.

A method for setting of blind rivets and blind rivet nuts is known from DE 43 39 117 A1, in which a tensile force is generated with an electric motor during a setting process. A setting device for blind rivets and blind rivet nuts with a tension mechanism driven by an electric motor is also known. In this method, the input current of the electric motor is monitored, in which case the consumed current is a direct gauge of the torque taken up by the electric motor. The tensile force of the setting device of the setter can be determined via the torque. The tensile force permits a conclusion concerning the quality of the rivet joint. Thus, the current trend can be used subsequently as a criterion for evaluating the setting process. In the method disclosed in DE 43 39 117 A1, it is monitored whether the consumed current of the electric motor reaches a maximum value during the setting process. If the maximum value is not so large that it falls within a stipulated target current range, this is a sign of defective riveting or an error in the setting device. If the maximum value is too large, this can be attributed to increased friction in the setting device, which is caused by soiling, or caused by choosing an incorrect rivet. A shortcoming in this method is that, here again, an evaluation of the setting process is made possible only subsequently. A setting process is then evaluated as acceptable, if the maximum value of the consumed current lies within the target current range. This means that setting processes are accepted, although perhaps before or after reaching the maximum value, the rivet element was pulled incorrectly. The maximum value can lie within the target current range, but the setting process can nevertheless be defective.

It is known from EP 0 454 890 A1 to provide a force measurement device in setting devices in the form of a strain gauge or pressure capsule. A shortcoming in such force measurement devices is that they represent additional components that involve additional cabling and wiring expense. Evaluation of the setting process is also conducted here only afterward by comparison with target values stored in a memory.

BRIEF SUMMARY

The task of the invention is to devise a method for setting of rivet elements with a portable riveting tool driven by an electric motor and such a riveting tool, which permits evaluation of the setting process already during the setting process of a rivet element. Interruption of the setting process is therefore to be made possible as soon as an error is found during the setting process. A method for setting of rivet elements and a riveting tool is also to be devised, which make it possible for the setting process to be actively changed during the setting process.

BRIEF DESCRIPTION OF THE DRAWINGS

Referring to the exemplary drawings.

DETAILED DESCRIPTION

Figure 1:
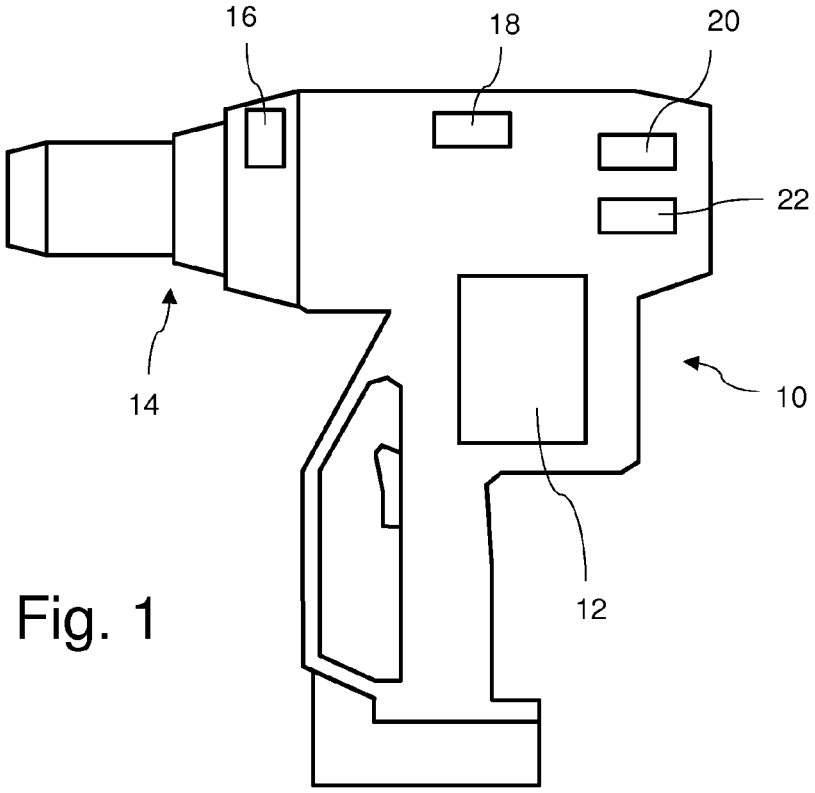
FIG. 1 is a side elevational view of an exemplary embodiment of a portable riveting tool according to the disclosure.
Figure 2:
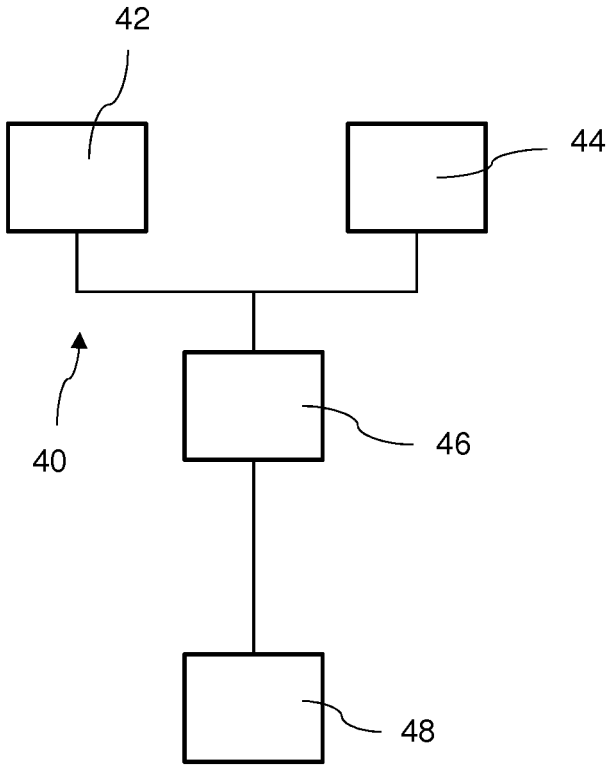
FIG. 2 is a flow chart of a method for setting rivet elements using the portable riveting tool illustrated in FIG. 1

According to the first aspect of the invention, and as illustrated in FIGS. 1 and 2, for example, the task is solved by a method 40 for setting of rivet elements with a portable riveting tool 10 driven by an electric motor 12, having a setting device 14, in which a force of the setting device, with which a riveting tool is set, is monitored 42 by means 16 of current consumed by the electric motor 12, in which a path that the rivet element covers during the setting process and/or the path that the setting device 14 covers during the setting process of the rivet element is repeatedly measured 44 by at least one sensor device 18, and in which, at each measurement point, the force of the setting device 14 applied at the corresponding measurement point is determined and compared 46 with a reference force value range for the corresponding measurement point, in which the setting process of the rivet element is not qualitatively accepted, if at one measurement point the force of the setting device 14 applied at this measurement point lies outside the reference force value range 48 for this measurement point.

The core of the invention is that the path covered by the rivet element and/or the setting device is repeatedly measured by a sensor device and the force of the setting device applied at each measurement point is determined. By comparing the force of the setting device applied at each measurement point with reference force value ranges for the corresponding measurement point, an evaluation of the quality of the setting process can be immediately performed. The riveting tool has a memory unit, in which the reference force value ranges for each measurement point are stored. Different reference force value ranges can then be stored for different rivet elements. Thus, a band region, within which the force applied by the setting device should lie, exists for each rivet element over the entire setting process. This band region extends from the beginning of the path to the end of the path covered by the rivet element or setting device. As soon as it is found at a measurement point that the force applied by the setting device lies outside the stipulated reference force value range for this measurement point, the setting process is not accepted. If the values determined at each measurement point lie within the stipulated reference force value range, the setting process is accepted.

An advantage of this method lies in the fact that it can be immediately and precisely established from which point the setting process ran incorrectly. Direct conclusions with respect to the setting process are made possible. Evaluation of the setting process can be conducted very frequently by repeated measurement and is therefore not merely dependent on the maximum consumed current. An error in the setting process can also be established before or after reaching the maximum current consumption of the electric motor. Through non-acceptance of a setting process, it can be immediately recognized by a user, generally a worker, that a rivet element was incorrectly set. Thus, an error during gripping of the gripping jaws of the setting device can already be established, if the force, with which the gripping jaws engage, lies above or below a reference force range for this path after a specified distance.

Repeated measurement according to the invention means that it is established, when a specific distance has been covered by the rivet element or setting device. After each specified path has been covered, a measurement of the applied force of the setting device is conducted. This means that for a number of paths, the force applied by the setting device to the rivet element is determined. In this case, every few milli- or micrometers, the applied force is determined. It is also conceivable that every few nanometers a measurement occurs. The frequency of measurements, i.e., the distances, after which a measurement is conducted, can be established beforehand.

Path measurement can occur by incremental or analog path sensors. Laser sensors, light barriers or inductive or capacitive sensors can also be used for path measurement.

The riveting tool is designed portable. The riveting tool preferably has a battery that supplies the riveting tool with electrical power. This permits very flexible use of the riveting tool. A process-safe, battery-operated, portable riveting tool can be created by the method.

It is also advantageous, if, in the method during establishment that the applied force of this setting device at a measurement point lies outside the reference force value range for this measurement point, an acoustic or optical error display occurs on the riveting tool. It is immediately displayed on this account that the setting process ran incorrectly. For example, during finding of an error during the setting process, an acoustic sound can be issued. The riveting tool in this variant has a loudspeaker unit. As an alternative or in addition, an optical display device, especially in the form of a display or lamp, like an LED, can be provided. On finding an incorrect setting process, a message "NOK", i.e., "not OK", can be displayed on the display. During finding of an incorrect setting process, this can also be displayed by lighting of a red lamp. The riveting tool therefore has a self-diagnosis function, which always produces an "NOK" result on failure or drift of the parameters. Since all measurement results are subject to dynamic processes, incorrect behavior of the setting process is immediately recognized. Such a method therefore permits a plausibility check. If the determined values at each measurement point lie within the stipulated reference force value ranges, the setting process is accepted, which can be displayed by the display "OK".

It is particularly advantageous, if in the method the applied force of the setting device is displayed on a display device of the riveting tool or on a display device assigned to the riveting tool with reference to the path covered by the rivet element or setting device. In addition to this force-path trend, the reference force value range can be displayed on the display device. Because of this, it can be recognized in timely fashion from which point an incorrect setting process occurred. By means of the slope of the curve that indicates the force of the setting device over the covered path, the riveting tool can recognize that an error will presumably occur. At each measurement point of the curve, the gradient can be calculated and displayed. By means of the gradient, it can be recognized whether the rivet element is pulled with an incorrect force and therefore setting speed. The curve trend of an optimal setting process lies within the reference force value range from beginning to end.

It is particularly advantageous, if in the method 40 the force of the setting device 14 applied for setting of the rivet element is regulated or controlled in dependency of the path covered by the rivet element or the setting device 14 by a regulation or control unit 22. This permits correction of the setting process during setting of the rivet element. The riveting tool 10 can actively engage in the setting process and change it. The regulation or control unit 22 recognizes, with reference to consecutive measurement points, whether the setting speed is too fast or too slow. On finding that the setting speed and therefore the force with which the rivet element is pulled is too high, the regulation or control unit 22 can throttle the applied force, in order to slow the setting speed somewhat. If the regulation or control unit 22 establishes that the rivet element is pulled too slowly by the setting device 14, it can increase the setting force and therefore the setting speed. This means that the regulation or control unit 22 can regulate the current intensity of the electric motor 12 of the riveting tool 10 as required.

A method for setting of a rivet element, in which, in addition to determination of the path and recording of the applied force, the time of the setting process is recorded, is also preferred. The force of the setting device for setting of the rivet element can then be regulated or controlled as a function of the covered path of the rivet element or setting device and the time required for the covered path. By changing the force, with which the setting device pulls the rivet element, the setting speed can be influenced.

A method, in which the setting process of the rivet element is ended after reaching a determinable maximum force, is also preferred. By interrupting the setting process of the rivet element, for example, of a blind rivet bolt or blind rivet nut, on reaching a pre-established force, the setting process is process-safe. After reaching the set maximum force, the setting device automatically switches off.

If the path covered by the rivet element during the setting process and/or the path covered by the setting device during the setting process of the rivet element is determined during the method by measurement of the rotation angle of the electric motor of the riveting tool, a comparison of the determined setting paths can be made possible. This means, in addition to the path measured by the sensor device, another path measurement is conducted. By this parallel path measurement system or by redundant path measurement, the process safety is increased. Measurement of the rotation angle can occur via Hall sensors.

It is also preferred, if the setting speed of the rivet element or setting device during the method can be kept constant over a determinable distance interval or over several determinable distance intervals, in which the setting speed of a distance interval can be different relative to the setting speed of another distance interval. This means that the setting speed of the rivet element can be changed. For example, if a first path is covered, the regulation or control unit can reduce or increase the setting speed, with which the rivet element is pulled. The entire path can be divided into different distance intervals, in which a different setting speed can be stipulated for each distance interval.

The setting device of the riveting tool has gripping jaws to grip the rivet element. It is preferred, if, after starting of the setting process, the gripping jaws of the setting device are closed with a first setting speed, if, after closure of the gripping jaws, the rivet element is pulled with a second higher setting speed in comparison with the first setting speed, and if, after covering a determinable path of the rivet element or of the setting device or a stipulated time, the rivet element is pulled with a third lower setting speed in comparison with the second setting speed. After starting of the rivet process, a smooth startup of the riveting tool occurs, until the gripping jaws of the setting device are enclosed. Through slow closure of the gripping jaws, abrasion of the rivet element, especially the rivet shank, is significantly reduced, which significantly lengthens the availability and use time of the riveting tool up to the next maintenance interval, i.e., cleaning of the gripping jaws. The gripping jaws of the setting device, through slow startup of the setting process, are not clogged as quickly with metal shavings of the rivet element. After closure of the gripping jaws, a more rapid stroke occurs by the setting device, until the rivet element has been plastically deformed drastically, in order to reach, by means of a lower setting speed, a slow and controlled joining of the rivet element up to optimal formation of the setting head of the rivet element and detachment of the rivet shank.

By active regulation and control of the speeds of the setting process, reproducible conditions in the rivet process are created, which make it possible for the joining speed to be brought into an optimal ratio with the material flow behavior of the rivet element and the setting behavior of the components being joined. Through the possibility of keeping the setting speed and force effects identical during each riveting, the process safety is increased. The setting speeds and the force effects are not subject to random events, but manageable physical quantities. The machine capability for a battery-operated riveting tool is therefore present. Cm and Cmk values of more than 1.67 and 2 are attainable.

An additional method step, in which all recorded paths and/or times that the rivet element or the setting device has covered or needed are stored in a memory unit of the riveting tool and/or documented in a force-path-time diagram, creates a particularly preferred method. For example, several reference force value ranges, target value windows, gradient curves or envelope cures for "OK" and "NOK" results can be defined in the memory unit. For the force, with which the setting device grips or pulls the rivet element, a specified measurement window can be defined. For different rivet elements, different measurement windows, reference force value ranges, gradient curves can be stipulated. The expression "OK" means "okay" or "setting process accepted" and the expression "NOK" means "not okay" or "setting process not accepted". The memory unit can be permanently installed in the riveting tool. As an alternative or in addition, a memory of the measured data can occur on a memory unit removable from the riveting tool, for example, on a micro-SD card, which are now available with a memory capacity of 128 MB to 8 GB.

It is also preferred that the object, in which a rivet element is set, is recorded by means of a scanner device of the riveting tool. The process control can be automated on this account. With the scanner device integrated in the riveting tool, all usual barcodes, including 2D codes, can be read. With the scanner device, it can unmistakably be determined even afterward on which object an incorrect setting process, i.e., an incorrect riveting, occurred. Through the scanner device, it can also be established in advance that the riveting tool was incorrectly programmed for the scanned object. It can therefore be recognized that rivet elements of a certain size must be used for the scanned object. However, if the riveting tool is set for setting of different rivet elements, an error message can be issued already before the beginning of riveting.

It is also advantageous, if the riveting tool has an input unit, and if reference values and reference values ranges for the time, the path and/or the setting force, as well as setting speeds of the setting device, can be entered. The course of a setting process of a rivet element can be stipulated by the input unit directly on the riveting tool and changed. However, it is preferable that data are transferred via at least one data interface from the riveting tool to a computer unit separate from the riveting tool and/or from a computer unit separate from the riveting tool to the riveting tool. Specific setting processes can thus be transferred to the riveting tool, which is simpler in comparison with input on the riveting tool. For data transmission, a USB interface can be present on the instrument side. Recorded and stored diagrams can be sent to the external computer unit via the USB interface. Since this is not possible during operation of the riveting tool, i.e., during setting of the rivet elements, the data are transferred via the USB interface after completion of the setting processes, so that they can be evaluated afterward. Recognition features of the object, on which riveting occurred, are added to the transmitted data, so that it is comprehensible where a rivet was not correctly set. Transmission of data can also occur in wireless fashion. For example, the data can be transmitted by infrared. A radio interface can be provided on the instrument side for data transmission. The radio interface can then be designed according to the common standards. The radio interface can be a Bluetooth interface, a WLAN interface, a Zigbee interface, etc. In addition, an interface, especially a digital interface, can be provided, which recognizes incorrect behavior in signal exchange between the regulation or control unit of the riveting tool and the computer unit. Data transmission can preferably occur both via a USB interface and via a radio interface.

It is also preferred, if the location, at which the rivet element is set, is illuminated in an additional step by means of an illumination device of the riveting tool. The user of the riveting tool can optimally inspect the rivet site on this account.

A method step is also preferred, in which the riveting tool has a pressure device to press the riveting tool against a component being riveted and a pressure switch, in which a setting process can only be started, when the pressure switch is tripped after a previous setting process. In this case, the pressure switch is actively monitored by the riveting tool, so that it cannot be tripped again with a pressed pressure switch that has already been tripped. The pressure switch must be released between two rivetings, so that the pressure device can be checked for functionality before each rivet process. This serves for better process monitoring, as well as manipulation safety of the riveting tool. This means on each new contact of the battery of the riveting tool, the pressure switch must be released, otherwise starting of the rivet process is not possible. The riveting tool therefore conducts self-diagnosis.

A method, in which at least one temperature sensor measures the temperature of the electric motor and/or the regulation or control unit, and this is considered during regulation and control of the force of the setting device to be applied during setting of the rivet element, is also preferred. The determined control temperature and/or motor temperature are considered during regulation by the regulation and control unit and compensate and eliminate fluctuations in power, or changes in efficiency. The setting process can be stabilized by the considered effect of temperatures.

It is also preferred, if in the method, by measuring the voltage parameters of the battery during the setting process, the capacity of the battery is determined, and that the riveting tool is switched off, if the determined capacity of the battery lies below a definable limit capacity. The voltage parameters are the no-load voltage, motor startup, if a current is added, and the internal resistance of the cells of the battery. The capacity of the battery can be calculated from the voltage parameters. In the ideal state, the battery has a capacity of 100%. The limit capacity can be given by a percentage. The limit capacity can amount to 5-8% of the ideal capacity.

If the battery, after shutdown of the motor of the riveting tool, has a residual capacity of less than 5%, the riveting tool is switched off, so that a new setting process cannot be conducted.

The battery, before each new setting process, must always have a certain power. By determining the capacity, it is recognized how capable the battery still is. This means the power of the battery must be above a certain minimum value, before the beginning of the next setting process. If the power of the battery is no longer sufficient for the subsequent work process, for example, a new setting process, the user is requested to change the battery. This preferably occurs by means of a certain message on the display device of the riveting tool. It is preferred that the riveting tool issue a warning message optically or acoustically, if the test unit finds that the capacity of the battery lies below the limit capacity and therefore the power of the battery is no longer sufficient for another setting process.

It can also be prescribed that if the riveting tool is not used over a certain period, for example, within 10 minutes, the riveting tool is automatically switched to power-saving mode. If the riveting tool is not used over a longer period, for example, within an hour, complete switching off of the riveting tool occurs, which can only be eliminated by pressing the start switch again or by contacting of the battery. It can therefore be prescribed that the battery must have a residual capacity of at least 70%, in order to be accepted by the riveting tool. The percentage of the required residual capacity can be different and stipulated according to the application.

In particular, the method just described for setting of blind rivets is preferred. Blind rivets represent a special form of rivet, which require only access to one side of the components being joined and are fastened with a riveting tool. A blind rivet comprises a longer, pushed-through rivet shank with head on the rear rivet end, in addition to the actual hollow rivet body with head on the front side, which is provided with a rupture site. During blind riveting, the joining process occurs from only one side of the component. The blind rivet is introduced through a hole in the components being joined, the rivet shank protruding at the head is then pulled out with the setting device of the riveting tool, designed especially as blind rivet tongs. This leads to compression and therefore widening of the rivet behind the hole. At the end of the process, the rivet shank breaks off at the rupture site within the rivet body and does not protrude from the rivet. The rest of the rivet shank is then situated in the setting device, i.e., the blind rivet tongs, and is discarded. In special applications, the shank residue remaining in the rivet can be secured with a ring pressed in during processing. Because of this, no parts can loosen and the higher shear strength of the shank material can be fully utilized. A blind rivet is normally a pull rivet. A blind rivet can also be a cup-head rivet or pull-through rivet.

The riveting tool can be programmed, so that it asks the user to empty the residual shank container after a certain number of rivetings. This occurs after pressing a reset switch, so that an automatic riveting tool block is activated.

According to the second aspect of the invention, the task is solved by a portable riveting tool 10 for setting of rivet elements, which is driven by an electric motor 12, having a setting device 14 for setting of a rivet element and a device for monitoring and determining the current consumed by the electric motor 12, in which the riveting tool 10 has a sensor device 18 for repeated measurement of the path that the rivet element covers during the setting process and/or the setting device 18 covers during the setting process of the rivet element, and a comparison device 20 to compare the force of the setting device 18 applied at each measurement point with a reference force value range, and for non-acceptance of the setting process of the rivet element, if, at a measurement point, the force of the setting device applied to this measurement point lies outside the reference force value range for this measurement point.

The portable riveting tool has means to execute the method described according to the first aspect. In this case, the comments concerning the first aspect are referred to. The portable riveting tool can have all the means described for execution of the method.

The invention claimed is:

1. Method for setting of rivet elements by a portable riveting tool driven by an electric motor, in which the electric motor is part of the portable riveting tool, having a setting device, in which a force of the setting device, with which a rivet element is set, is monitored by means of current consumed by the electric motor, wherein a path that the rivet element covers during the setting process and/or that the setting device covers during the setting process of the rivet element is repeatedly measured by at least one sensor device, and wherein at each measurement point, the force of the setting device applied at the corresponding measurement point is determined and compared with a reference force value range for the corresponding measurement point, wherein the setting process of the rivet element is not qualitatively accepted, if, at a measurement point, the force of the setting device applied at this measurement point lies outside the reference force value range for this measurement point, and wherein the force of the setting device applied for setting of the rivet element is regulated during setting of the rivet element as a function of the covered path of the rivet element or the setting device by a control unit.

2. Method according to claim 1, wherein the riveting tool is supplied with electrical power by a battery.

3. Method to claim 1, wherein, on determining that at a measurement point the applied force of the setting device lies outside the reference force value range for this measurement point, an acoustic or optical error display occurs on the riveting tool.

4. Method according claim 1, wherein on a display device of the riveting tool or on a display device assigned to the riveting tool, the applied force of the setting device is displayed with reference to the covered path of the rivet element or setting device.

5. Method according claim 1, wherein the setting process is recorded in time, and the force of the setting device applied for setting of the rivet element is regulated or controlled in dependency of the covered path of the rivet element or setting device and the time required for the covered path.

6. Method according to claim 1, wherein the setting process of the rivet element is ended after reaching a determinable maximum force.

7. Method according to claim 1, wherein the path that the rivet element covers during the setting process and/or that the setting device covers during the setting process of the rivet element is determined by measurement of the rotation angle of the motor.

8. Method according to claim 1, wherein the setting speed of the rivet element or setting device can be kept constant over a determinable distance interval or over several determinable distance intervals, in which the setting speed of a distance interval can be different from the setting speed of another distance interval.

9. Method according to claim 1, wherein all recorded paths and/or times that the rivet element or the setting device has covered or needed, and all recorded forces that the setting device applied are stored in a memory unit of the riveting tool and/or documented in a force-path-time diagram.

10. Method according to claim 1, wherein the setting device has gripping jaws to grip the rivet element, and after starting of the setting process, the gripping jaws of the setting device are closed with a first setting speed, after closure of the gripping jaws, the rivet element is pulled with a second setting speed higher in comparison with the first setting speed, and after covering a determinable path of the rivet element or of the setting device or a stipulated time, the rivet element is pulled with a third setting speed lower in comparison with the second setting speed.

11. Method according to claim 1, wherein the object, in which a rivet element is set, is recorded by means of a scanning device of the riveting tool.

12. Method according to claim 1, wherein the riveting tool has an input unit, and wherein reference values or reference value ranges are entered for the time, path and/or setting force, as well as the setting speeds of the setting device.

13. Method according to claim 1, wherein data are transmitted via at least one data interface from the riveting tool to a computer unit separate from the riveting tool and/or from a computer unit separate from the riveting tool to the riveting tool.

14. Method according to claim 1, wherein the location where the rivet element is set is illuminated by means of an illumination device of the riveting tool.

15. Method according to claim 1, wherein the riveting tool has a pressure device to press the riveting tool against a component being riveted and a pressure switch, in which a setting process can only be started when the pressure switch has been released after a previous setting process.

16. Method according to claim 1, wherein at least one temperature sensor measures the temperature of the electric motor and/or the regulation or control unit and considers the temperature during regulation or control of the force of the setting device to be applied for setting of the rivet element.

17. Method according to claim 1, wherein blind rivets are set by the setting device of the riveting tool.

18. Method according to claim 2, wherein by measurement of voltage parameters of the battery during the setting process, the capacity of the battery is determined, and the riveting tool is switched off, when the determined capacity of the battery lies below a definable limit capacity.

19. Method according to claim 18, wherein the riveting tool issues a warning message optically or acoustically, when the test unit finds that the capacity of the battery lies below the limit capacity and therefore the power of the battery is no longer sufficient for another setting process.

* * * * *